US010458162B2

(12) United States Patent
Braxton, Jr.

(10) Patent No.: US 10,458,162 B2
(45) Date of Patent: Oct. 29, 2019

(54) LATCHING DEVICE

(71) Applicant: Walter Holland Braxton, Jr., Grand Ridge, FL (US)

(72) Inventor: Walter Holland Braxton, Jr., Grand Ridge, FL (US)

( * ) Notice: Subject to any disclaimer, the term of this patent is extended or adjusted under 35 U.S.C. 154(b) by 129 days.

(21) Appl. No.: 15/582,060

(22) Filed: Apr. 28, 2017

(65) Prior Publication Data

US 2018/0313121 A1 Nov. 1, 2018

(51) Int. Cl.
*E05C 19/18* (2006.01)
*E05F 15/63* (2015.01)

(52) U.S. Cl.
CPC ..... *E05C 19/184* (2013.01); *E05F 15/63* (2015.01); *E05Y 2900/132* (2013.01)

(58) Field of Classification Search
CPC ..... E05C 19/184; E05C 17/12; E05C 17/14; E05C 19/10; E05C 19/18; E05C 19/188; E05C 21/00; E05F 15/63; E05Y 2900/132
USPC ..... 292/288, 291, 294, 347, 348–350, 292/DIG. 2; 16/422
See application file for complete search history.

(56) References Cited

U.S. PATENT DOCUMENTS 211,660 A 1/1879 Hotchkiss
1,590,690 A 6/1926 Hurd
2,775,001 A * 12/1956 Baker ..... E05B 65/0888 292/258
2,815,238 A * 12/1957 Miller ..... E05B 65/0894 292/258
3,189,936 A 6/1965 Lee
4,213,211 A * 7/1980 Bemis ..... A47K 13/005 4/235
5,533,717 A * 7/1996 Del Raso ..... B25B 1/205 269/108
5,865,484 A * 2/1999 Johns ..... E05C 19/182 292/288
6,079,369 A * 6/2000 Hill ..... A01K 1/0272 119/771
6,447,031 B1 * 9/2002 O'Hanlon ..... E05B 1/0053 16/413
7,017,959 B2 * 3/2006 Selness ..... E05C 19/007 292/292
7,350,836 B2 4/2008 Simpson
9,644,395 B2 * 5/2017 Strand ..... E05B 13/002
2014/0306464 A1 10/2014 Lowe

* cited by examiner

*Primary Examiner* — William V Gilbert
(74) *Attorney, Agent, or Firm* — Adrienne Love

(57) ABSTRACT

The present invention comprises a latch for holding, locking, and/or securing an articulated entryway. The latch is generally comprised of a hook, a front and rear fastener, and an exterior and interior pressure plate. The hook attaches to the articulated arm on the door, and, by manipulating the position of the fasteners, the exterior pressure plate is tightened against the door plate. Once the latch is in its intended position, the articulated arm is locked in a fixed position, preventing the door from being opened.

17 Claims, 6 Drawing Sheets

LATCHING DEVICE

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices designed and manufactured for holding, locking, and/or securing an articulated entryway.

2. Description of the Related Art

The primary focus of the present invention is to thwart and/or stall the entry of an assailant, primarily in what has been coined an "active shooter" scenario. The modern landscape has revealed an ugly reality that many facilities in which individuals spend much of their waking hours, are ill-equipped to prevent the entry of an armed and dangerous assailant. Even where the entryway contains a standard locking mechanism, these locking mechanisms can easily be rendered ineffective and dismantled when exterior force is applied. Accordingly, the need for a more secure method and device to act as the primary or secondary locking mechanism remains steadfast to protect innocent people from harm.

As such, many facilities, including offices, business, and schools, have installed doors or entryways which utilize articulated arms to assist in the opening and closing of such. A prior art door closer 38 is shown in FIG. 1. In businesses and schools many doors are installed so that they open in an outward direction. Some school districts mandate that classroom doors open outward, such that in the event of a fire, the students can escape even if the students are crowding the exit. FIG. 1 illustrates a door closer 38 mounted to the doorjamb 36 on a door that swings outward. A door plate 28 attaches to the door jamb 36 and protrudes outward beyond the frame of the door. The door plate 28 is often an L shape. An operator 30 attaches to the upper portion of the door 34. An articulating arm 32 connects the door plate 28 to the operator 30. When the door 34 swings outward, the door closer 38, slowly pulls the door 34 back to a closed position.

While these articulated entryways may include standard locking mechanisms to prevent outside intruders, the utilization of the articulated arm in creating a secure point to create a primary or secondary securing clasp to bar entry, has not been fully designed or implemented. Utilization of the articulated arm places the latching mechanism in an area than is less susceptible to exterior force or projectiles, and thereby significantly reduces the potential for the locking mechanism to fail.

Therefore, what is needed is a simple, yet secure, latching mechanism to secure an articulated entryway from outward intruders. The present invention achieves this objective, as well as others, that are explained in the following description.

BRIEF SUMMARY OF THE INVENTION

The present invention comprises a latching device for attachment to a door closer attached to a door. When attached, the latching device maintains the door in a closed position. The door closer has a door plate attached to a doorjamb and an operator attached to a door. An articulating arm connects the operator to the door plate. The latching device includes a shaft having a first end and a second end. At the first end of the device is a hook large enough to hook around the end of the articulating arm that attaches to the operator. A length of threading extends from the second end to the mid-point of the shaft. An exterior pressure plate having a first side and a second side is removably attached to the shaft. The first side of the exterior pressure plate faces the first end of the shaft and the second side faces the second end. A front fastener is secured to the length of threading such that the front fastener is in contact with the first side of the exterior pressure plate. A rear fastener is secured to the length of threading proximate the second side of the exterior pressure plate. An interior pressure plate is disposed between the second side of the exterior pressure plate and the rear fastener. The exterior pressure plate is held securely in place on the shaft by the rear and front fasteners. An end cap is fixed to the second end of the shaft.

In operation, the hook curves around the articulating arm at the point where the articulating arm attaches to the operator of door closer. The user can adjust the point of the exterior pressure plate along the shaft by manipulating the rear fastener and front fastener, such that the exterior pressure plate can clear the posterior edge of the door plate. The second end of shaft and the exterior pressure plate are then pivoted rearward towards the door plate. Once the exterior pressure plate is in place the user can rotate the rear fastener to tighten a portion of the exterior pressure plate against the posterior end of the door plate. The position of the device prevents the articulating arm from expanding (opening out). Thus, the door remains in a closed position.

REFERENCE NUMERALS IN THE DRAWINGS

[10] Latching Device
[12] Hook
[14] Shaft
[16] Threading
[18] Front Fastener
[20] Exterior Pressure Plate

[22] Interior Pressure Plate
[24] Rear Fastener
[26] End Cap
[28] Door Plate
[30] Operator
[32] Articulating Arm
[34] Door
[36] Doorjamb
[38] Door closer
[40] Mid-section
[42] Second end
[44] First end
[46] First side
[48] Second side

DETAILED DESCRIPTION OF THE INVENTION

Figure 1:
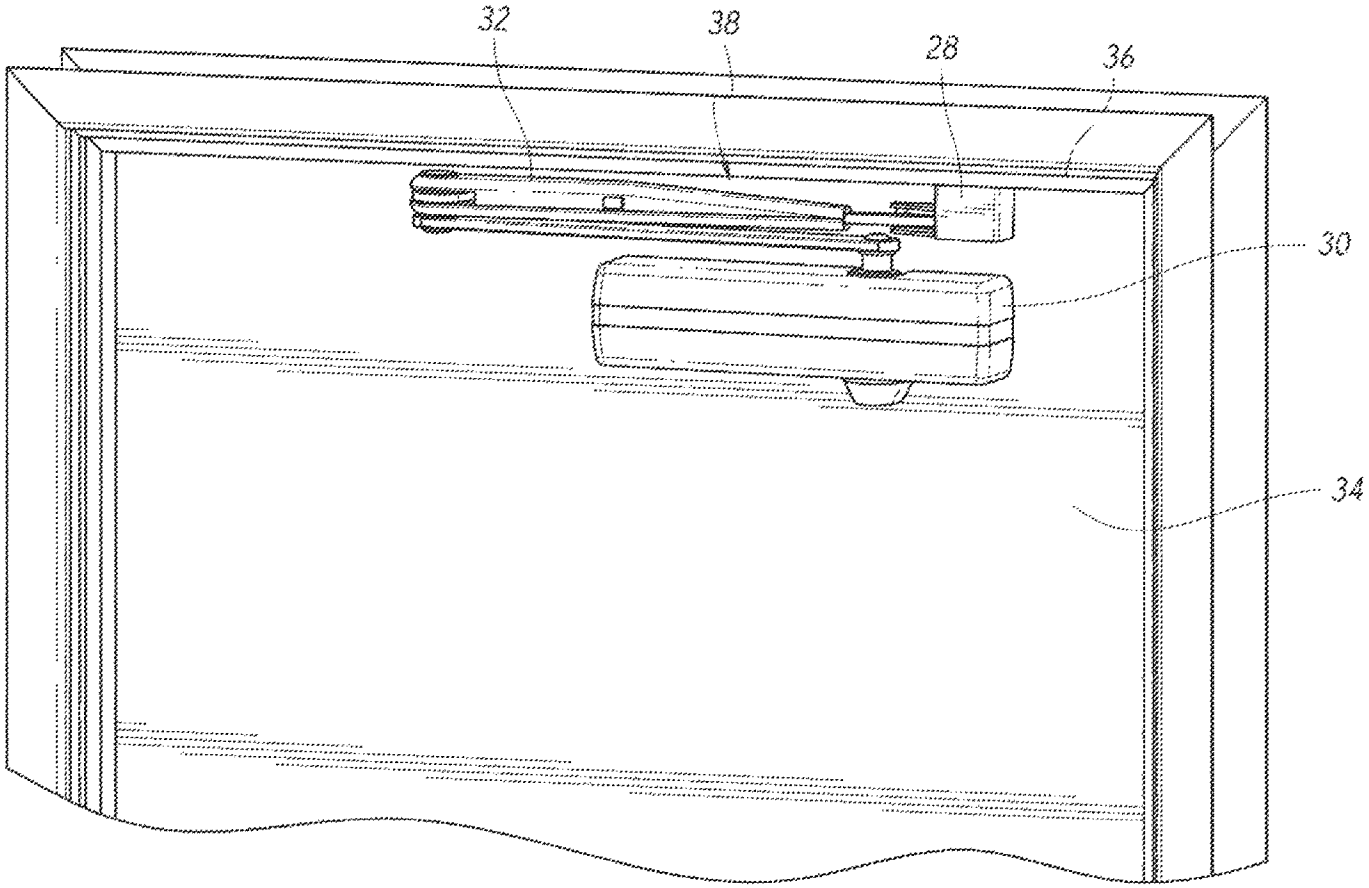
FIG. 1 (PRIOR ART)
FIG. 1 is a perspective view of a prior art door closer.
Figure 2:
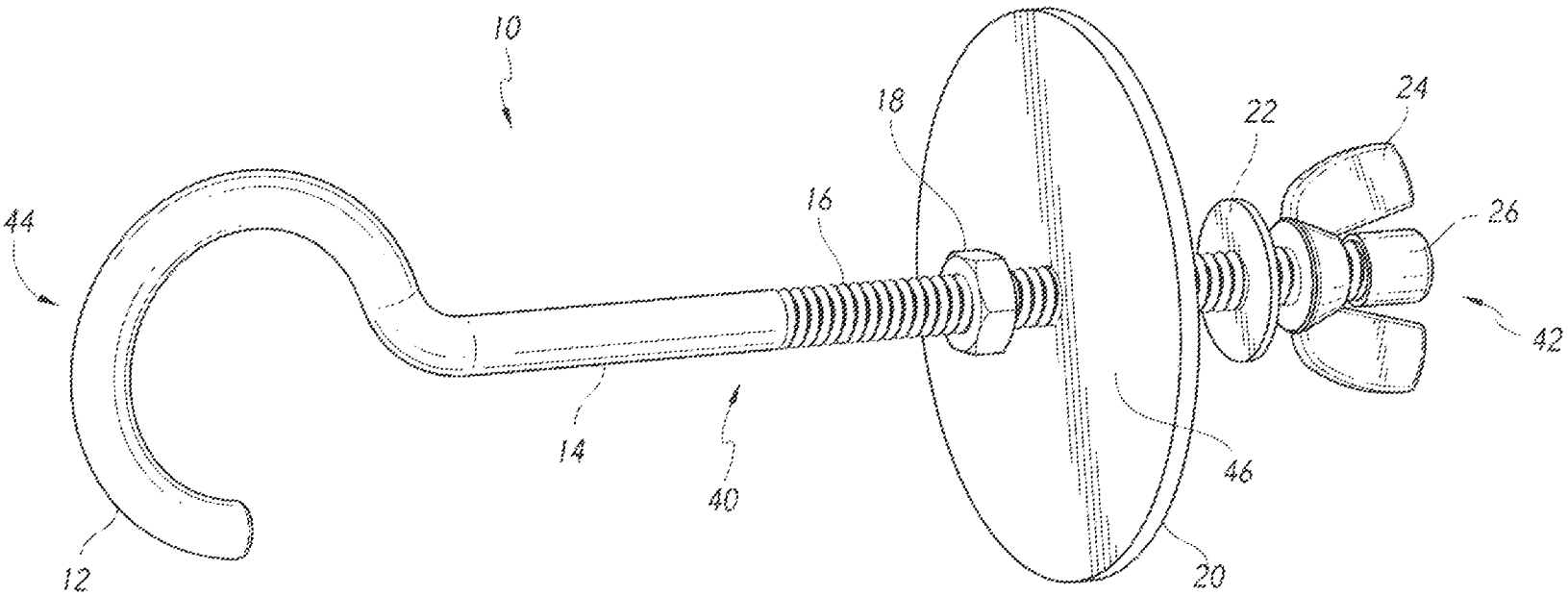
FIG. 2 is a perspective view, showing the present invention.
Figure 3:
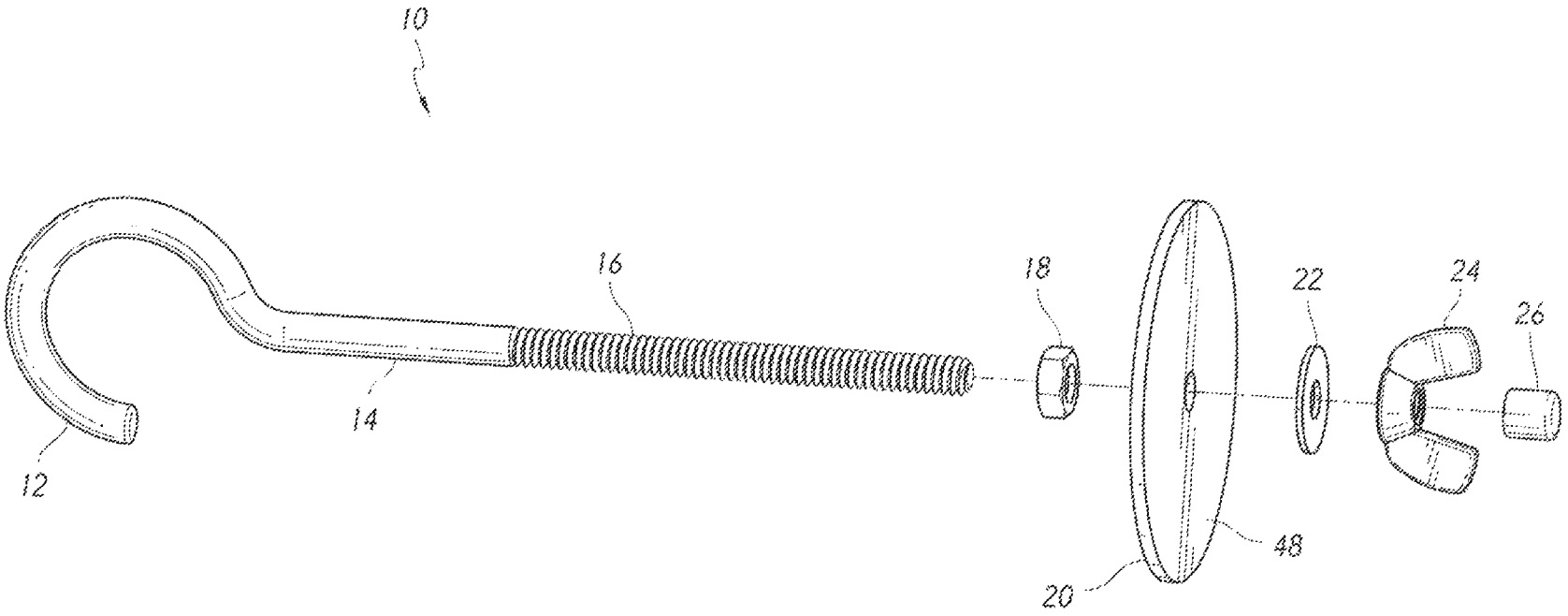
FIG. 3 is an exploded view, present invention's components, in their proper alignment.

FIG. 2 illustrates the present invention in the preferred embodiment, with FIG. 3 providing an exploded view of the present invention, with the individual components in their preferred order and alignment. The latching device 10 comprises of a single metal or composite hook 12, which extends down to a straightened shaft 14. A length of threading 16 extends from approximately the midpoint of the shaft 14, to end cap 26. End cap 26 is fixedly attached to shaft 14. During the manufacturing and assembly process, the front fastener 18 is threaded onto the shaft threading 16, starting at the second (posterior) end 42 on the straightened shaft 14, and rotating it in a clockwise fashion, moving it toward the hook 12 or first end 44 of the shaft 14.

The second end 42 of shaft 14 is placed through the hole located in the middle of the exterior pressure plate 20, and the exterior pressure plate 20 is moved forward, toward the hook 12, until it immediately abuts the front fastener 18. Front fastener 18 is preferably a simple nut, but can be any type of fastener that can prevent exterior pressure plate 20 from moving towards first end 44 of shaft 14. Exterior pressure plate 20 has a first side 46, facing hook 12, and a second side 48, facing end cap 26. The desired position of the exterior pressure plate 20 is approximately at the mid-section 40 of shaft 14. Exterior pressure plate 20 can be any type of plate designed to accept a force applied to the plate. In the present example, the exterior pressure plate 20 is a large, thick washer (preferably at least 6 centimeters in diameter and at least 4 millimeters in thickness) designed to hold the device 10 in place as a force is applied to the door 34 (and subsequently the articulating arm 32 (further illustrated in FIG. 6). The interior pressure plate 22 (in the current embodiment—a smaller second washer) is then placed onto the shaft 14 in the same manner as the exterior pressure plate 20, and is moved forward, toward the hook 12, until it immediately abuts the exterior pressure plate 20. The rear fastener 24 is then threaded onto the threading 16 of the shaft 14, starting at the second end 42, and moved forward to the hook 12, until it immediately abuts the interior pressure plate 22. Rear fastener 24 can be any type of fastener which prevents exterior pressure plate 20 and interior pressure plate 22 from translating toward second end 42 of shaft 14. End cap 26 is then placed on the second end 42 of the shaft 14. End cap 26 can be any type of cap that is capable of being secured to the second end of shaft 14. For example, end cap 26 could be a threaded cap that can twist onto the end of shaft 14. The latching device 10 is then considered fully assembled.

Figure 4:
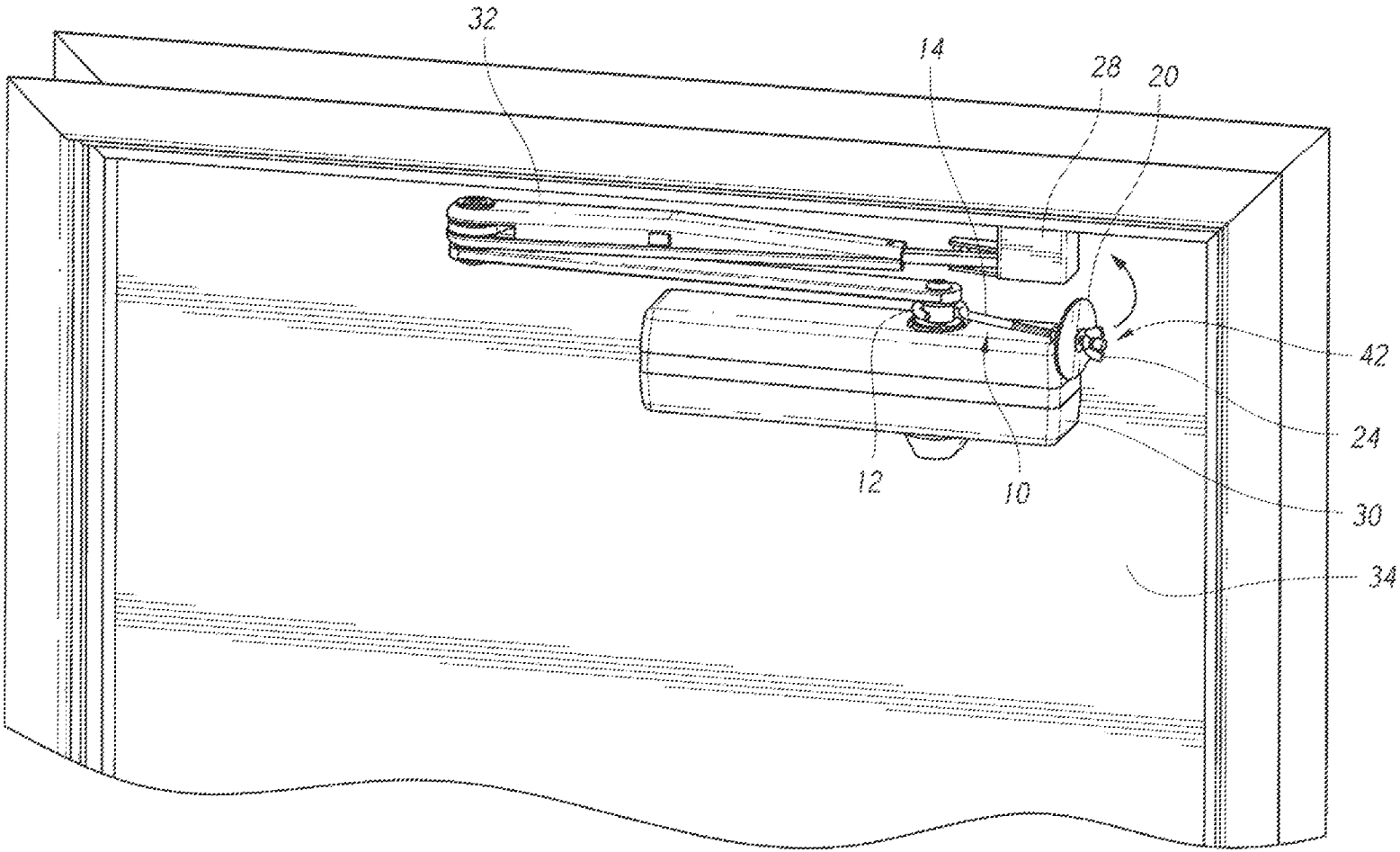
FIG. 4 is a perspective view, of the present invention being attached to the articulated arm, with a magnified view of the pertinent area.
Figure 5:
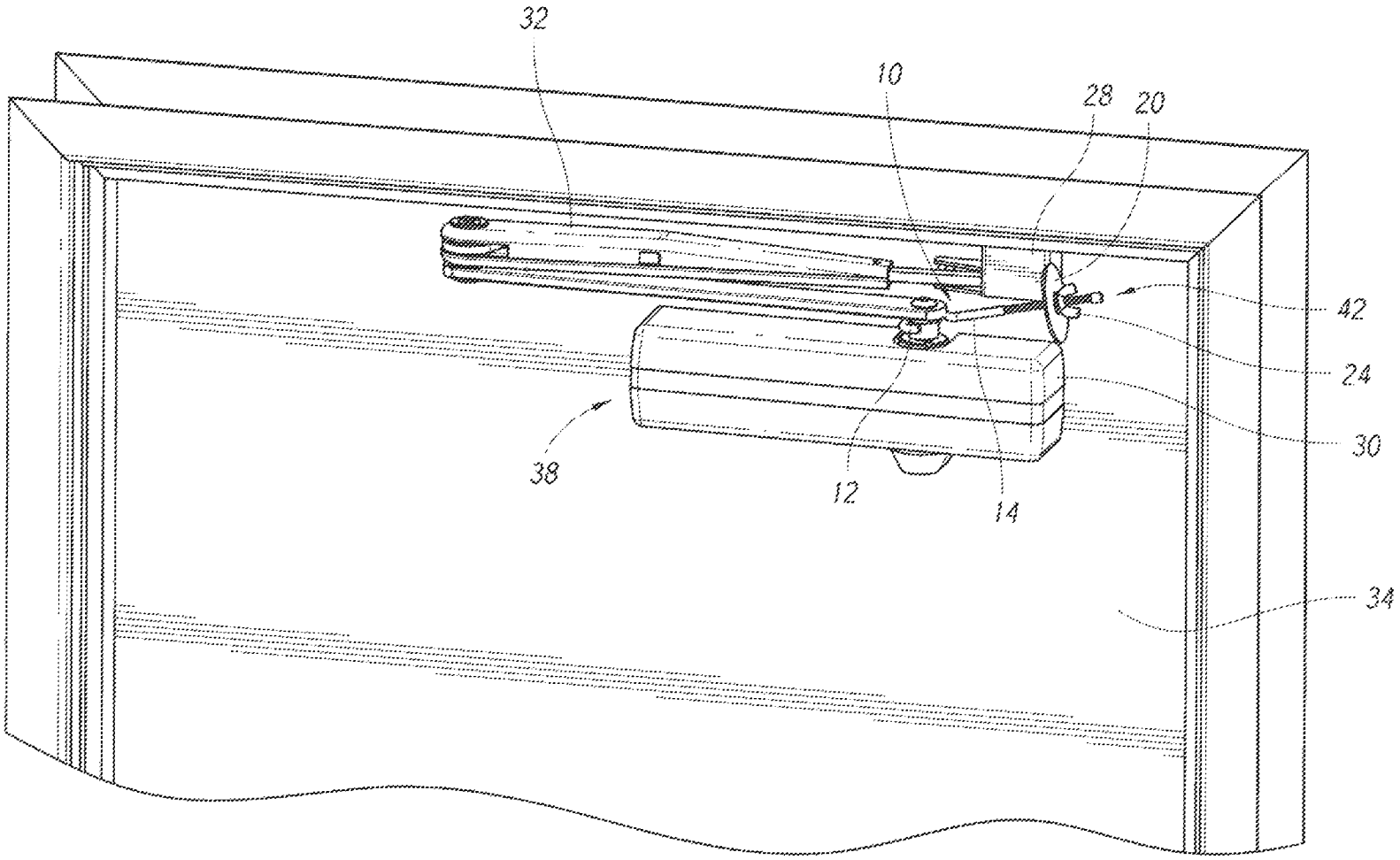
FIG. 5 is a perspective view, showing the present invention in its anticipated final and effective position.

FIG. 4 is a perspective view of latching device 10 being attached to the articulated arm on entryway. The user places hook 12 around articulated arm 32 at the point where the articulating arm connects to operator 30 on the posterior of the entryway. Hook 12 is oriented so that second end 42 of shaft 14 is pointed toward door plate 28 on the entryway threshold. The user will adjust front fastener 18 and rear fastener 24 (illustrated in FIGS. 2 and 3), as necessary, to allow the exterior pressure plate 20 to clear the posterior edge of door plate 28. Second end 42 of shaft 14 and exterior pressure plate 20 are then pivoted rearward towards door plate 28, as shown by the directional arrow. FIG. 5 shows exterior pressure plate 20 pivoted into position abutting the posterior edge of door plate 28. Once in position, the user will rotate rear fastener 24 clockwise, as needed, to tighten the exterior pressure plate 20 against the posterior end of the door plate 28. The user can easily and quickly pivot latching device 10 in place thereby allowing for easy and quick installation in an emergency. In this position the latching device 10 is fully attached to door closer 38. This device 10 is useful for entryways in which the door is attached such that it swings outward, away from the interior of the room. It is in these entryways that door closers 38 include a door plate 28 that, from a side plan view, is shaped as an upside down "L".

Figure 6:
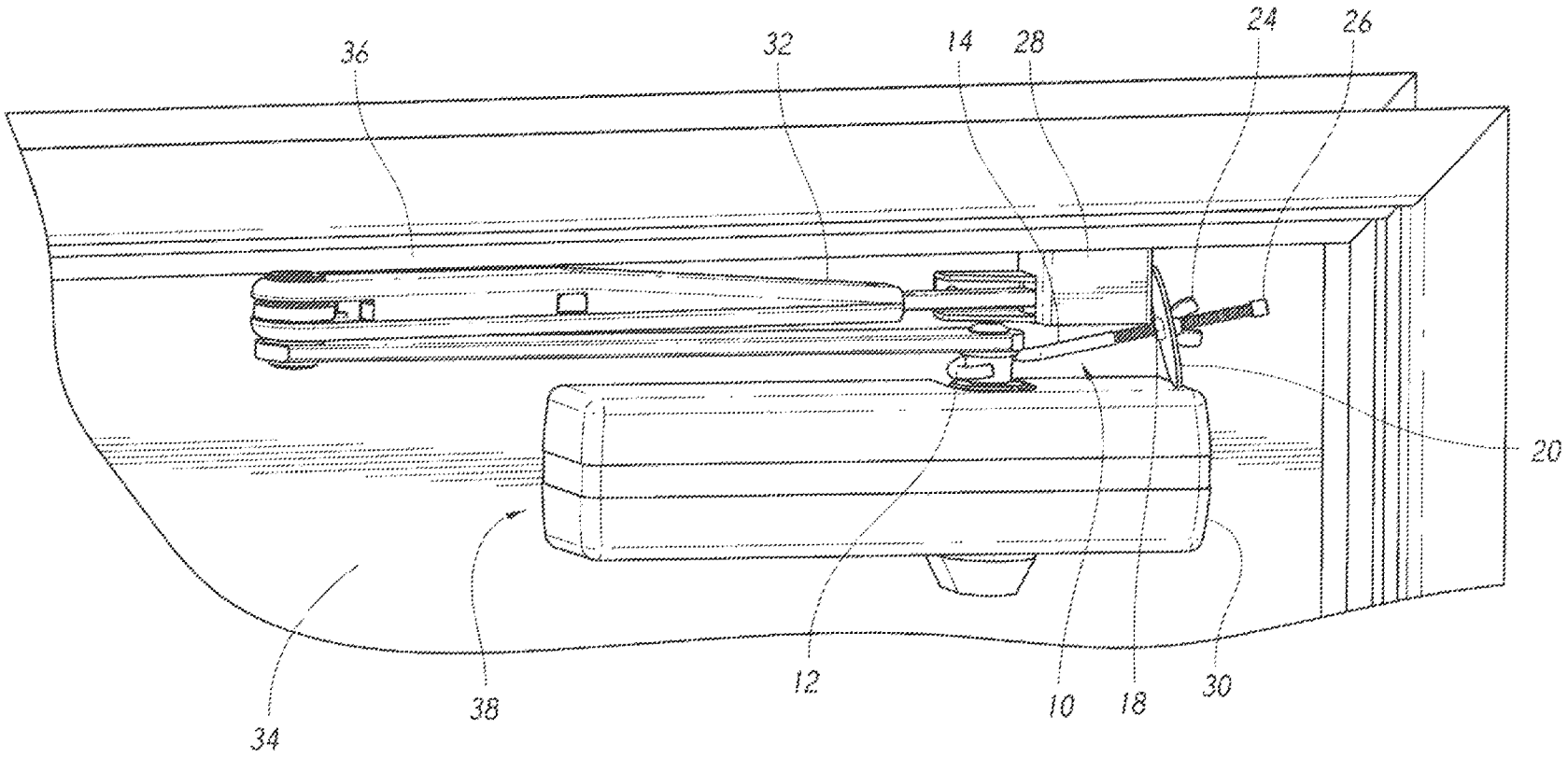
FIG. 6 is a close-up perspective view, showing the present invention in its anticipated final and installed position.

A close-up perspective view is shown in FIG. 6. In this view, front fastener 18 abutting first side 46 of exterior pressure plate 20 is illustrated in detail. Hook 12 is attached to articulating arm 32 on the entryway, and exterior pressure plate 20 is tightened against the posterior end of the door plate 28 with the front fastener 18 on the outside of the door plate 28. The latching device 10 locks articulating arm 32 on the entryway towards door plate 28, keeping articulating arm 32 in a closed, fixed position, preventing door from being opened from the outside.

Having described my invention, I claim:

1. A latching device for attachment to a door closer, said latching device comprising:
- a shaft having a first end and a second end;
- wherein said first end of said shaft has a hook;
- wherein said shaft and said hook are integral and in one piece;
- wherein said door closer has an articulating arm;
- wherein said hook curves around said articulating arm of said door closer;
- wherein said second end of said shaft has a length of threading;
- an end cap fixed to said second end of said shaft proximate said threading;
- an exterior pressure plate having a first side and a second side encircling said shaft;
- wherein said first end of said exterior pressure plate is capable of making contact with a posterior end of said door plate and preventing said articulating arm of said door closer from expanding;
- a rear fastener secured to said shaft proximate said second side of said exterior pressure plate;
- a front fastener secured to said shaft proximate said first side of said exterior pressure plate; and
- wherein said front fastener and said rear fastener hold said exterior pressure plate in a fixed location along said shaft.

2. A latching device as recited in claim 1, further comprising an interior pressure plate having a diameter disposed between said exterior pressure plate having a diameter and said rear fastener, wherein said diameter of said exterior pressure plate is larger than said diameter of said interior pressure plate.

3. A latching device as recited in claim 2, wherein said interior pressure plate is a second washer that is smaller in size than said exterior pressure plate.

4. A latching device as recited in claim 1, wherein said threading of said shaft extends from said second end of said shaft to a mid-point of said shaft.

5. A latching device as recited in claim 1, wherein said rear fastener is a wing nut.

6. A latching device as recited in claim 1, wherein said front fastener is a nut.

7. A latching device as recited in claim 1, wherein said exterior pressure plate is a washer.

8. A latching device as recited in claim 7, wherein said washer has a diameter and said diameter is at least 6 centimeters.

9. A latching device as recited in claim 7, wherein said washer has a thickness and said thickness is at least 4 mm.

10. A latching device for attachment to a door closer, said latching device comprising:

a shaft having a first end and a second end;

wherein said first end of said shaft is a hook;

wherein said shaft and said hook are integral and in one piece;

wherein said door closer has an articulating arm;

wherein said hook curves around said articulating arm of said door closer;

wherein said second end of said shaft includes a length of threading;

an exterior pressure plate having a first side and a second side removably attached to said shaft, wherein said first side faces said first end of said shaft and said second side faces said second end of said shaft;

wherein said first end of said exterior pressure plate is capable of making contact with a posterior end of said door plate and preventing said articulating arm of said door closer from expanding;

a front fastener secured to said threading of said shaft in contact with said first side of said exterior pressure plate;

a rear fastener secured to said threading of said shaft proximate said second side of said exterior pressure plate;

an interior pressure plate disposed between said second side of said exterior pressure plate and said rear fastener;

wherein said exterior pressure plate is held securely in place on said shaft by said rear fastener and said front fastener; and an end cap fixed to said second end of said shaft.

11. A latching device as recited in claim 10, wherein said length of threading extends from said second end of said shaft to a mid-point of said shaft.

12. A latching device as recited in claim 10, wherein said rear fastener is a wing nut.

13. A latching device as recited in claim 10, wherein said front fastener is a nut.

14. A latching device as recited in claim 10, wherein said exterior pressure plate is a washer.

15. A latching device as recited in claim 14, wherein said washer has a diameter and said diameter is at least 6 centimeters.

16. A latching device as recited in claim 15, wherein said washer has a thickness and said thickness is at least 4 mm.

17. A latching device as recited in claim 14, wherein said interior pressure plate is a second washer that is smaller in size than said exterior pressure plate.

* * * * *